US010248077B2

(12) United States Patent
Numata et al.

(10) Patent No.: US 10,248,077 B2
(45) Date of Patent: Apr. 2, 2019

(54) CARTRIDGE AND COVER MEMBER

(71) Applicant: CANON KABUSHIKI KAISHA, Tokyo (JP)

(72) Inventors: Tetsuya Numata, Suntou-gun (JP); Takuya Kawakami, Mishima (JP); Yohei Kusano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/288,981

(22) Filed: Oct. 7, 2016

(65) Prior Publication Data

US 2017/0108823 A1 Apr. 20, 2017

(30) Foreign Application Priority Data

Oct. 14, 2015 (JP) ..... 2015-203144

(51) Int. Cl.
*G03G 21/18* (2006.01)

(52) U.S. Cl.
CPC ..... *G03G 21/1814* (2013.01); *G03G 21/181* (2013.01); *G03G 21/1842* (2013.01)

(58) Field of Classification Search
None
See application file for complete search history.

(56) References Cited

U.S. PATENT DOCUMENTS

2008/0145119 A1* 6/2008 Tatsumi ..... G03G 21/181 399/359
2012/0057899 A1* 3/2012 Asanuma ..... G03G 21/1825 399/111
2013/0177334 A1* 7/2013 Nonaka ..... G03G 21/0023 399/111
2014/0072339 A1* 3/2014 Munetsugu ..... G03G 21/1825 399/113

FOREIGN PATENT DOCUMENTS

JP 10-20660 A 1/1998
JP 2001-125472 A 5/2001
JP 2006-330694 A 12/2006
JP 2014-228822 A 12/2014

* cited by examiner

*Primary Examiner* — Thomas S Giampaolo, II
(74) *Attorney, Agent, or Firm* — Canon U.S.A., Inc. IP Division

(57) ABSTRACT

A cartridge includes a cover member including a substantially disc-shaped planar portion extending in a direction orthogonal to an axis of rotation of a photosensitive drum, a first projection portion projecting from the planar portion toward an outside in the direction of the axis of rotation, the first projection portion configured to abut on the positioning portion so that the first frame is positioned within an apparatus main body, a concave portion recessed from the planar portion toward an inner side in the direction of the axis of rotation, and a second projection portion provided in the concave portion, the second projection portion projecting from the concave portion toward an outside in the direction of the axis of rotation, the second projection portion configured to engage with one end of an urging member.

9 Claims, 19 Drawing Sheets

CARTRIDGE AND COVER MEMBER

BACKGROUND

Field

Aspects of the present invention generally relate to a cartridge provided with an electrophotographic photosensitive drum for use in an electrophotographic image forming apparatus and also relates to a cover member.

Description of the Related Art

In an electrophotographic image forming apparatus (hereinafter, simply referred to as an image forming apparatus as well), a photosensitive member typically having a drum shape, or in other words, a photosensitive drum that serves as an image carrying member, is charged uniformly. Then, the charged photosensitive drum is selectively exposed, and an electrostatic latent image (electrostatic image) is formed on the photosensitive drum. The electrostatic latent image formed on the photosensitive drum is then developed into a toner image using toner serving as a developer. Thereafter, the toner image formed on the photosensitive drum is transferred onto a recording material, such as a recording sheet or a plastic sheet, and the toner image transferred to the recording material is heated and pressurized, whereby the toner image is fixed on the recording material and an image is thus recorded.

Such an image forming apparatus typically needs to be replenished with toner and requires maintenance on various process units therein. In order to facilitate the toner replenishment or the maintenance, a process cartridge is put into practice in which a photosensitive drum, a charging unit, a developing unit, a cleaning unit, and so on are located collectively within a frame and integrated into a cartridge that can be mounted on and detached from an image forming apparatus main body.

This process cartridge system enables a user to carry out maintenance on the image forming apparatus by themselves, which significantly improves the operability of the image forming apparatus, making it possible to provide an image forming apparatus that shows good usability. Therefore, the process cartridge system is widely used in image forming apparatuses.

According to Japanese Patent Application Laid-Open No. 10-20660, the process cartridge described above is provided with a cover member that is fixed at one end in the axial direction of the photosensitive drum (hereinafter, the longitudinal direction) to a frame and rotationally supports the photosensitive drum. The cover member is provided with a planar portion extending along a plane orthogonal to the axial direction of the photosensitive drum and a first convex portion extending from the planar portion toward the outside in the longitudinal direction. The first convex portion is positioned and supported by a positioning portion provided in the image forming apparatus (hereinafter, simply referred to as an apparatus main body as well), and thus the process cartridge performs positioning relative to the apparatus main body.

SUMMARY

Aspects of the present invention are generally directed to providing a cartridge provided with a photosensitive drum that is more advanced than a conventional cartridge.

A cartridge mountable on an apparatus main body including a positioning portion includes a photosensitive drum, a first frame configured to rotatably support the photosensitive drum, a second frame configured to rotatably support a developing roller, a cover member provided on the first frame at one end thereof in a direction of an axis of rotation of the photosensitive drum, and an urging member configured to urge the developing roller against the photosensitive drum. The cover member includes a substantially disc-shaped planar portion extending in a direction orthogonal to the axis of rotation, a first projection portion projecting from the planar portion toward an outside in the direction of the axis of rotation, the first projection portion configured to abut on the positioning portion so that the first frame is positioned within the apparatus main body, a concave portion recessed from the planar portion toward an inner side in the direction of the axis of rotation, and a second projection portion provided on the concave portion, the second projection portion projecting from the concave portion toward an outside in the direction of the axis of rotation, the second projection portion configured to engage with one end of the urging member.

Further features of aspects of the present invention will become apparent from the following description of exemplary embodiments with reference to the attached drawings.

DESCRIPTION OF THE EMBODIMENTS

Figure 1:
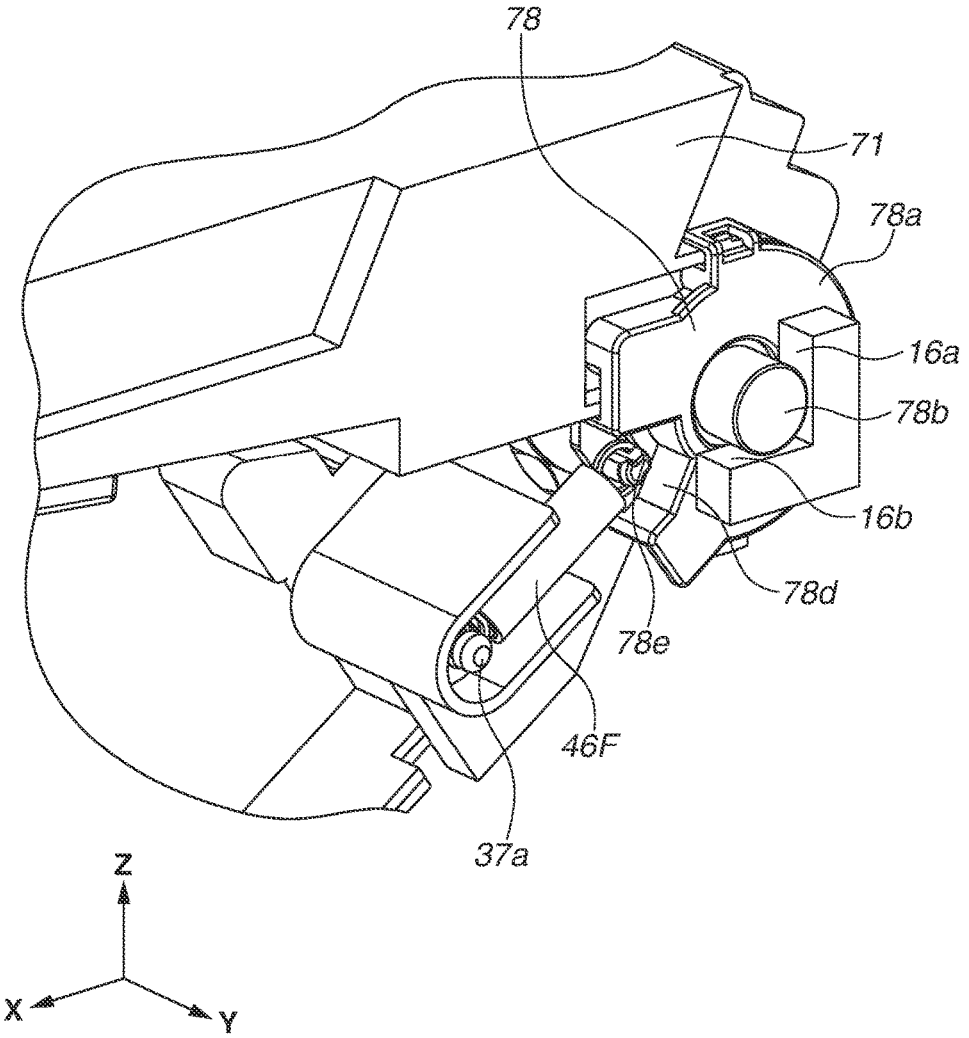
FIG. 1 is a perspective view of a process cartridge and a non-drive side positioning portion of an image forming apparatus main body when the process cartridge is mounted on an electrophotographic image forming apparatus main body.

Hereinafter, a first exemplary embodiment of the present invention will be described in detail with reference to the drawings.

In the first exemplary embodiment, the direction parallel to the axis of rotation of an electrophotographic photosensitive drum is referred to as a longitudinal direction. The longitudinal direction corresponds to the Y-direction in the drawings. In addition, the directions orthogonal to the Y-direction are referred to as the X-direction and the Z-direction, and the X-direction and the Y-direction are orthogonal to each other. The X-direction, the Y-direction, and the Z-direction are used in common in all the drawings. The directions to which the arrows in the drawings point are positive (+) directions. In the description, a positive direction is referred to as the Y-direction, and the direction opposite to the Y-direction is referred to as the −Y-direction with a negative sign (−) attached in front thereof. With regard to the Y-axis, the Y-direction corresponds to a first direction, and the −Y-direction corresponds to a second direction. In addition, in the longitudinal direction, a side at which an electrophotographic photosensitive drum receives a driving force from an electrophotographic image forming apparatus main body is referred to as a drive side (the other end), and a side opposite to the drive side is referred to as a non-drive side (one end). The overall configuration and an image forming process will be described with reference to FIGS. 2 and 3.

Figure 2:
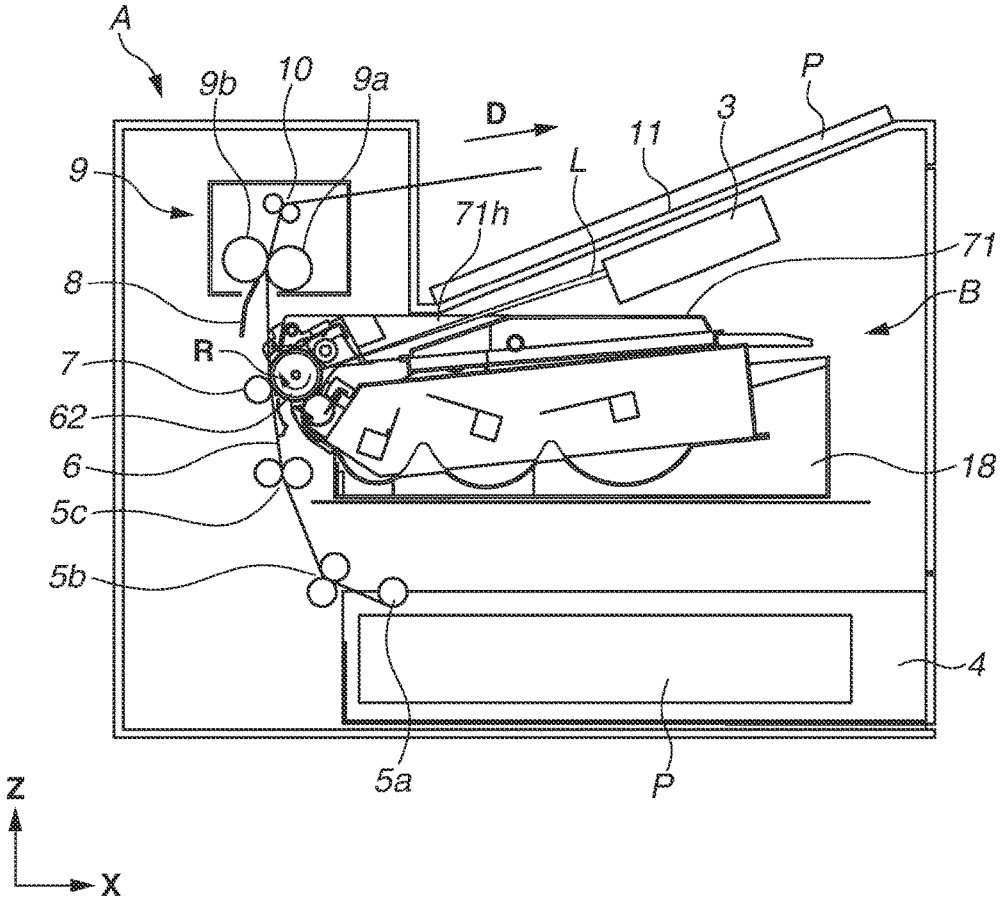
FIG. 2 is sectional view of the image forming apparatus main body of the electrophotographic image forming apparatus and the process cartridge.

FIG. 2 is a sectional view of an image forming apparatus main body (hereinafter, referred to as the apparatus main body A) of an electrophotographic image forming apparatus and a process cartridge (hereinafter, referred to as the cartridge B) according to an exemplary embodiment of the present invention.

Figure 3:
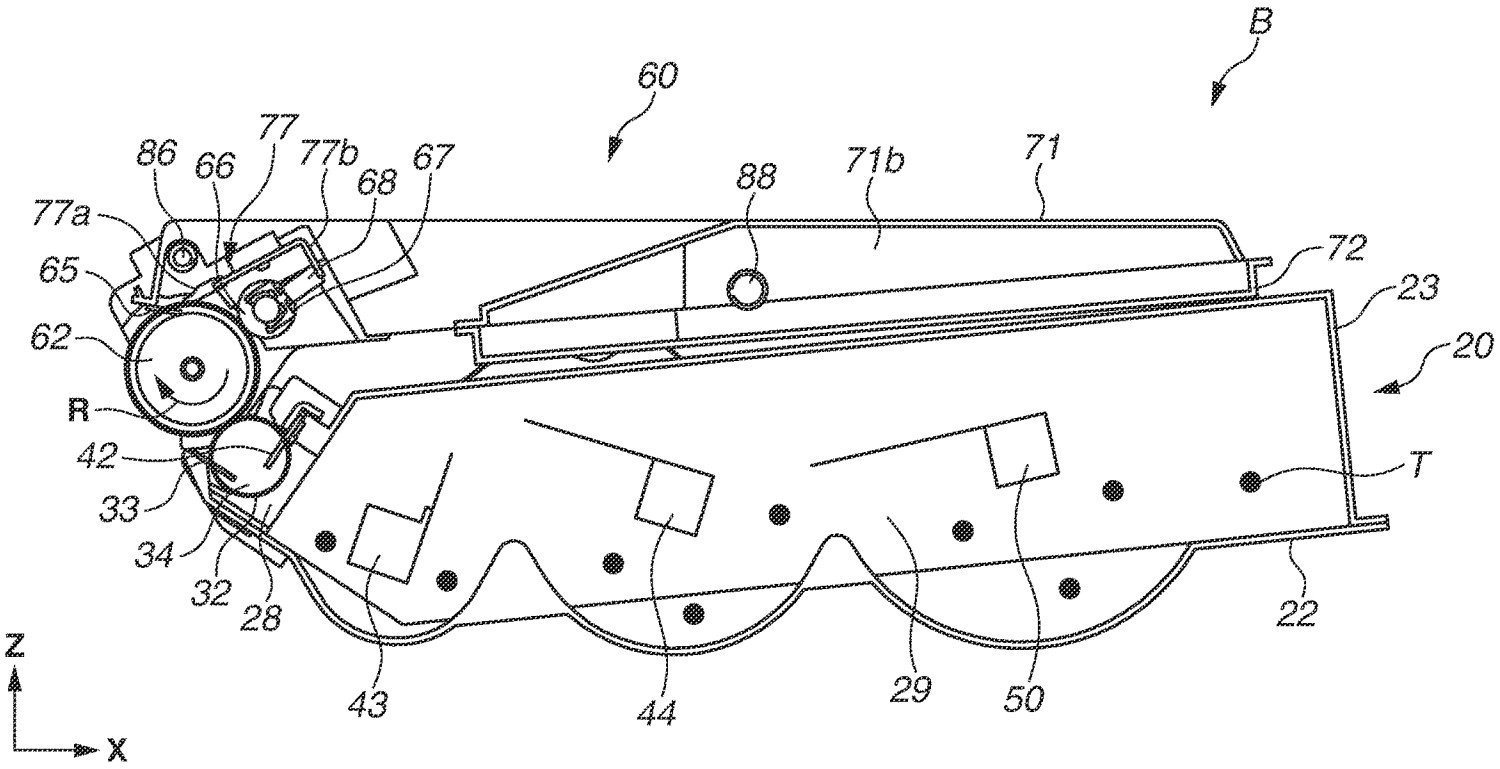
FIG. 3 is a sectional view of the process cartridge.

FIG. 3 is a sectional view of the cartridge B. Herein, the apparatus main body A is a portion of the electrophotographic image forming apparatus excluding the cartridge B.

<Overall Configuration of Electrophotographic Image Forming Apparatus>

The electrophotographic image forming apparatus illustrated in FIG. 2 is a laser beam printer employing electrophotographic technology and is configured such that the cartridge B can be freely mounted on or detached from the main body A. When the cartridge B is mounted on the main body A, an exposure device 3 (laser scanner unit) for forming a latent image on an electrophotographic photosensitive drum 62 of the cartridge B is correspondingly disposed. In addition, a sheet tray 4 that holds a recording medium (hereinafter, referred to as a sheet material P) on which an image is to be formed is disposed underneath the cartridge B.

In the apparatus main body A, along a conveyance direction D of the sheet material P, a pickup roller 5*a*, a feeding roller pair 5*b*, a conveyance roller pair 5*c*, a transfer guide 6, a transfer roller 7, a conveyance guide 8, a fixing device 9, a discharge roller pair 10, a discharge tray 11, and so on are disposed in order. The fixing device 9 includes a heating roller 9*a* and a pressure roller 9*b*.

<Image Forming Process>

Next, an outline of the image forming process will be described. Based on a print start signal, the electrophotographic photosensitive drum (hereinafter, referred to as the drum) 62 is rotationally driven in the direction of the arrow R at a predetermined circumferential speed (process speed).

A charging roller 66, to which a bias voltage is applied, contacts and uniformly charges the outer peripheral surface of the drum 62. The exposure device 3 outputs a laser beam L corresponding to image information. The laser beam L passes through a laser opening 71*h* provided in a cleaning frame 71 of the cartridge B and the outer peripheral surface of the drum 62 is scanned with the laser beam. Thus, an electrostatic latent image corresponding to the image information is formed on the outer peripheral surface of the drum 62.

As illustrated in FIG. 3, in a developing unit 20, which serves as a developing device, toner T in a toner room 29 is agitated, conveyed, and fed out to a toner supply room 28 by rotation of a first conveyance member 43, a second conveyance member 44, and a third conveyance member 50.

The surface of a developing roller 32 carries the toner T owing to the magnetic force of a magnet roller 34 (stationary magnet).

The toner T is frictionally charged and its thickness on the peripheral surface of the developing roller 32 is regulated by a developing blade 42. The toner T is developed onto the drum 62 in accordance with the electrostatic latent image, and the electrostatic latent image is turned into a visible image in the form of a toner image.

As illustrated in FIG. 2, in accordance with the output timing of the laser beam L, the sheet material P held in a lower portion of the apparatus main body A is fed out from the sheet tray 4 by the pickup roller 5*a*, the feeding roller pair 5*b*, and the conveyance roller pair 5*c*. Then, the sheet material P passes through the transfer guide 6 and is conveyed to a transfer position between the drum 62 and the transfer roller 7. At this transfer position, the toner image is successively transferred onto the sheet material P from the drum 62.

The sheet material P on which the toner image has been transferred is separated from the drum 62 and is conveyed to the fixing device 9 along the conveyance guide 8. The sheet material P then passes through a nip portion between the heating roller 9*a* and the pressure roller 9*b*, which constitute the fixing device 9. Pressure and heat fixing processing is carried out at this nip portion, and the toner image is thus fixed on the sheet material P. The sheet material P that has undergone the toner image fixing processing is conveyed to the discharge roller pair 10 and is discharged to the discharge tray 11.

As illustrated in FIG. 3, the drum 62 that has undergone the transfer has the residual toner on the outer peripheral surface thereof, which is removed by a cleaning member 77 and re-used in the image forming process. The toner removed from the drum 62 is stored in a waste toner room 71*b* of a cleaning unit 60.

In the foregoing, the charging roller 66, the developing roller 32, the transfer roller 7, and the cleaning member 77 are the process units that work on the drum 62.

<Mounting and Detaching Cartridge>

Figure 5:
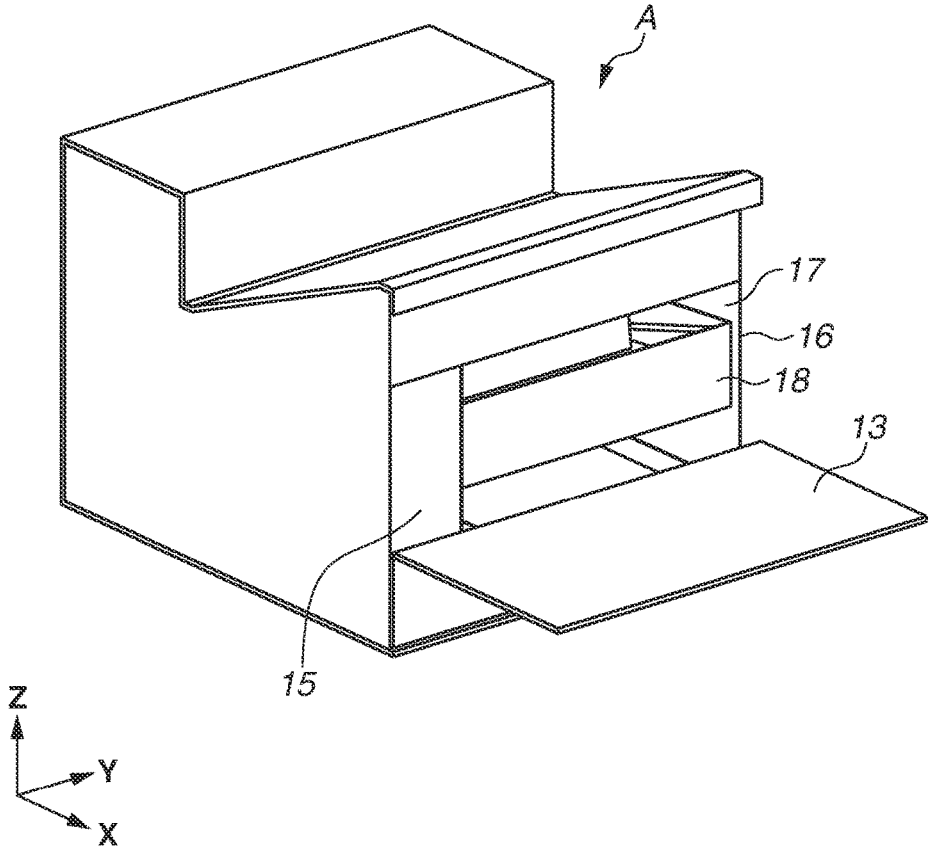
FIG. 5 is a perspective view of the image forming apparatus main body when an opening/closing door of the electrophotographic image forming apparatus is open.
Figure 6:
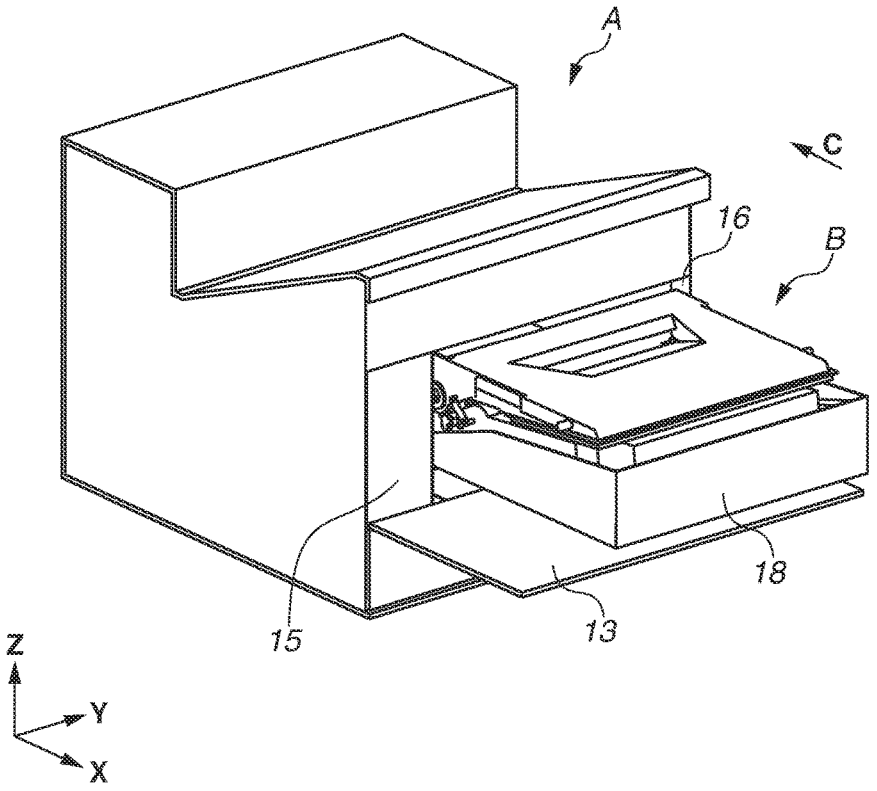
FIG. 6 is a perspective view of the image forming apparatus main body when the opening/closing door of the electrophotographic image forming apparatus is open and a tray is pulled out.
Figure 7:
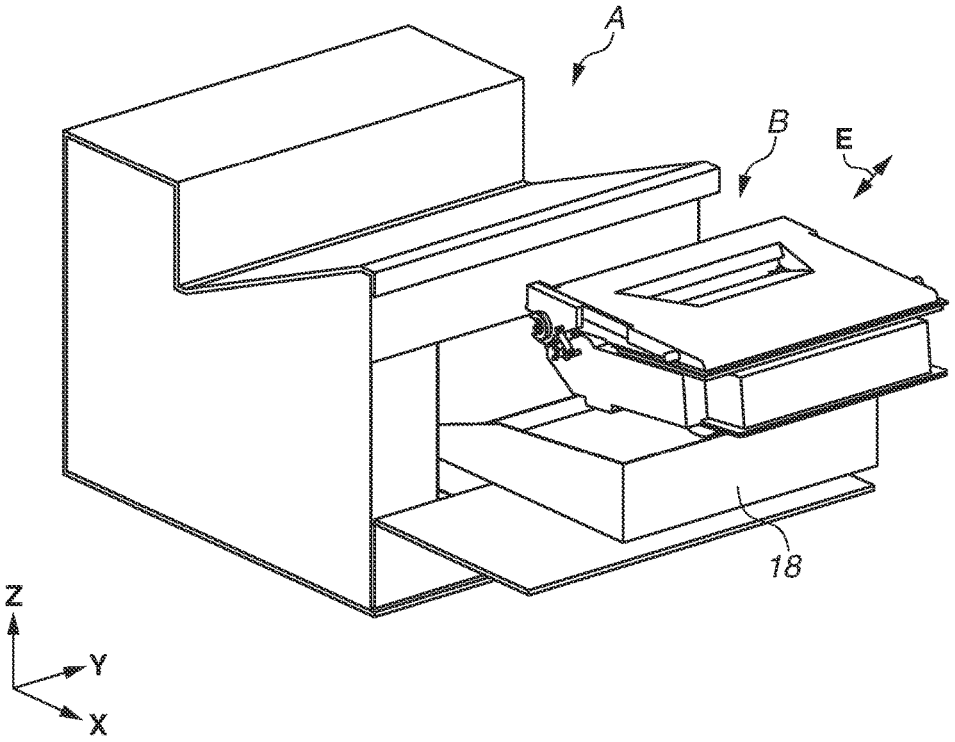
FIG. 7 is a perspective view of the image forming apparatus main body and the process cartridge with the process cartridge mounted on or detached from the tray when the opening/closing door of the electrophotographic image forming apparatus is open and the tray is pulled out.

Next, mounting or detaching of the cartridge B to or from the apparatus main body A will be described with reference to FIGS. 5 and 6. FIG. 5 is a perspective view of the apparatus main body A in which an opening/closing door 13 is opened so as to mount or detach the cartridge B. FIG. 6 is a perspective view of the apparatus main body A and the cartridge B in a state where the opening/closing door 13 is opened and a tray 18 is pulled out to mount or detach the cartridge B. FIG. 7 is a perspective view of the apparatus main body A and the cartridge B while the cartridge B is mounted or detached in a state where the opening/closing door 13 is opened and the tray 18 is pulled out. The cartridge B can be mounted on or detached from the tray 18 in a mounting and detaching direction E.

The opening/closing door 13 is pivotally attached to the apparatus main body A, and a cartridge insertion port 17 is provided behind the opening/closing door 13. The tray 18 for mounting the cartridge B on the apparatus main body A is provided within the cartridge insertion port 17. When the tray 18 is pulled out to a predetermined position, the cartridge B can be mounted on or detached from the cartridge B. The cartridge B is attached to the apparatus main body A along a guide rail (not illustrated) in the direction of the arrow C in FIG. 6 in a state where the cartridge B is placed on the tray 18.

A first drive shaft 14 and a second drive shaft 19 are provided to transmit a driving force to a first coupling 70 and a second coupling 21 (FIG. 8) placed in the cartridge B. The first drive shaft 14 and the second drive shaft 19 are driven by a motor (not illustrated) of the apparatus main body A. Thus, the drum 62 coupled to the first coupling 70 rotates upon receiving the driving force from the apparatus main body A. The developing roller 32 rotates when the driving is transmitted thereto from the second coupling 21. Electricity is supplied to the charging roller 66 and the developing roller 32 from an electricity supplying unit (not illustrated) of the apparatus main body A.

<Support of Cartridge>

Figure 8:
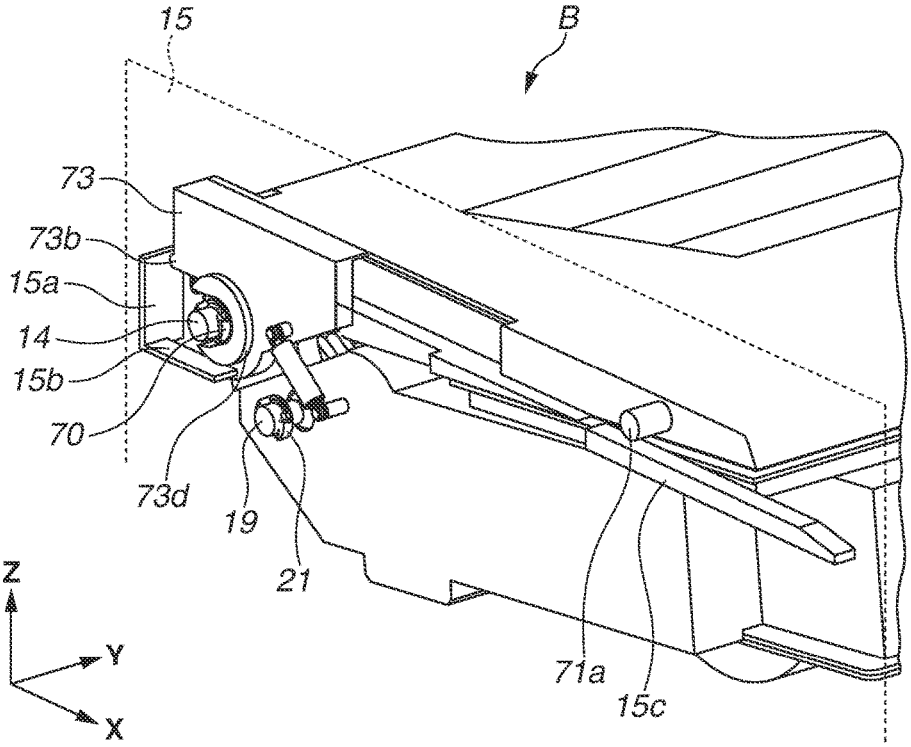
FIG. 8 is a perspective view of the process cartridge and a drive side positioning portion of the image forming apparatus main body when the process cartridge is mounted on the electrophotographic image forming apparatus main body.
Figure 9:
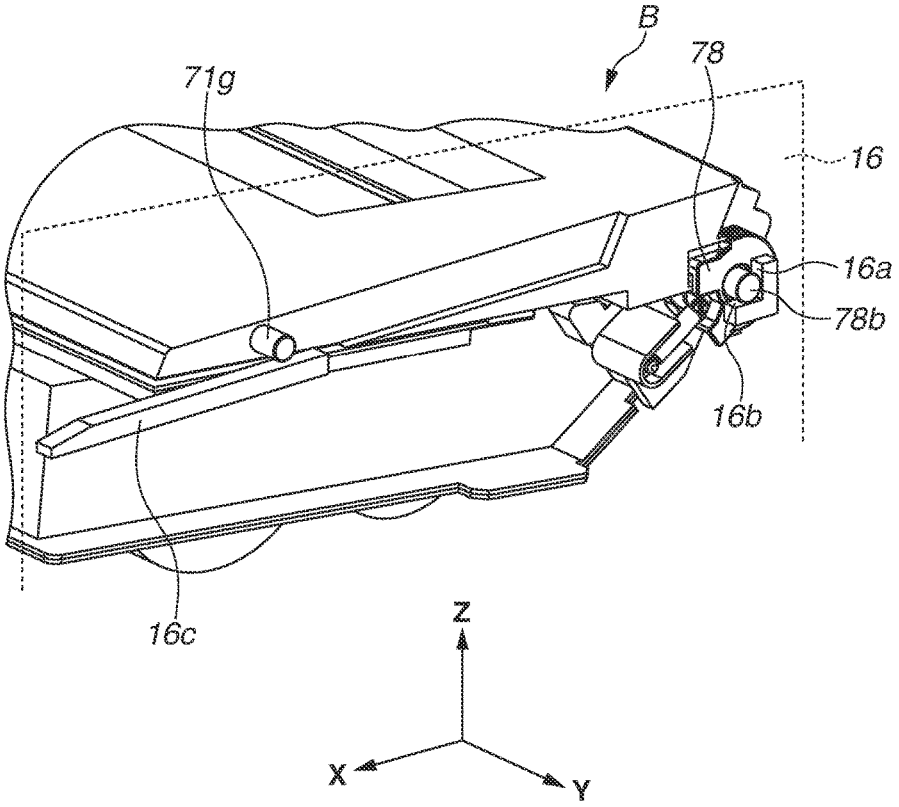
FIG. 9 is a perspective view of the process cartridge and the non-drive side positioning portion of the image forming apparatus main body when the process cartridge is mounted on the electrophotographic image forming apparatus main body.

As illustrated in FIG. 5, the apparatus main body A is provided with a drive side plate 15 and a non-drive side plate 16 for supporting the cartridge B. As illustrated in FIGS. 8 and 9, the drive side plate 15 is provided with a drive side first support 15*a*, a drive side second support 15*b*, and a rotation support 15*c* for the cartridge B. The non-drive side plate 16 is provided with a non-drive side first support 16*a*, a non-drive side second support 16*b*, and a rotation support 16*c*, which serve as positioning portions.

As supported portions of the cartridge B, a supported portion 73*b* and a supported portion 73*d* of a drum bearing member 73, a drive side boss 71*a* and a non-drive side boss 71*g* of the cleaning frame 71, and a non-drive side projection portion 78*b* of a cover member 78 are provided. The supported portion 73*b* is supported by the drive side first support 15*a*, the supported portion 73*d* is supported by the drive side second support 15*b*, and the drive side boss 71*a* is supported by the rotation support 15*c*. The non-drive side projection portion 78*b*, which serves as a first projection portion, is supported by the non-drive side first support 16*a* and the non-drive side second support 16*b*, and the non-drive side boss 71*g* is supported by the rotation support 16*c*. Thus, the cartridge B is positioned inside the apparatus main body A.

<Overall Configuration of Cartridge>

Figure 10:
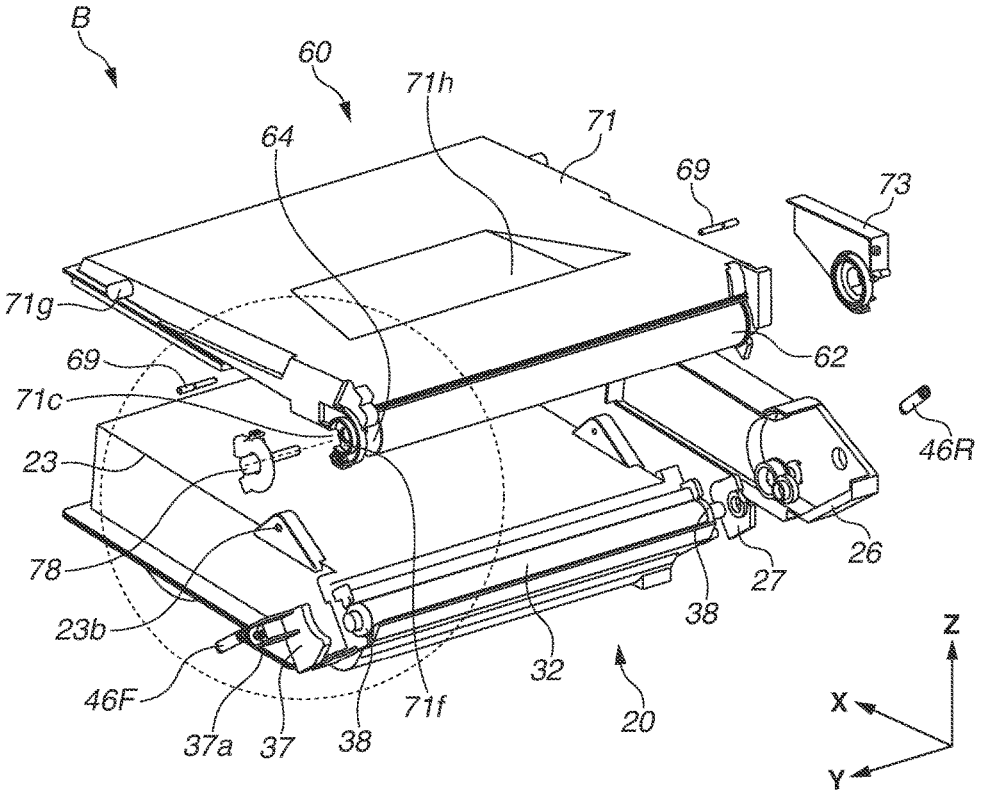
FIG. 10 is an exploded view of the process cartridge.
Figure 11:
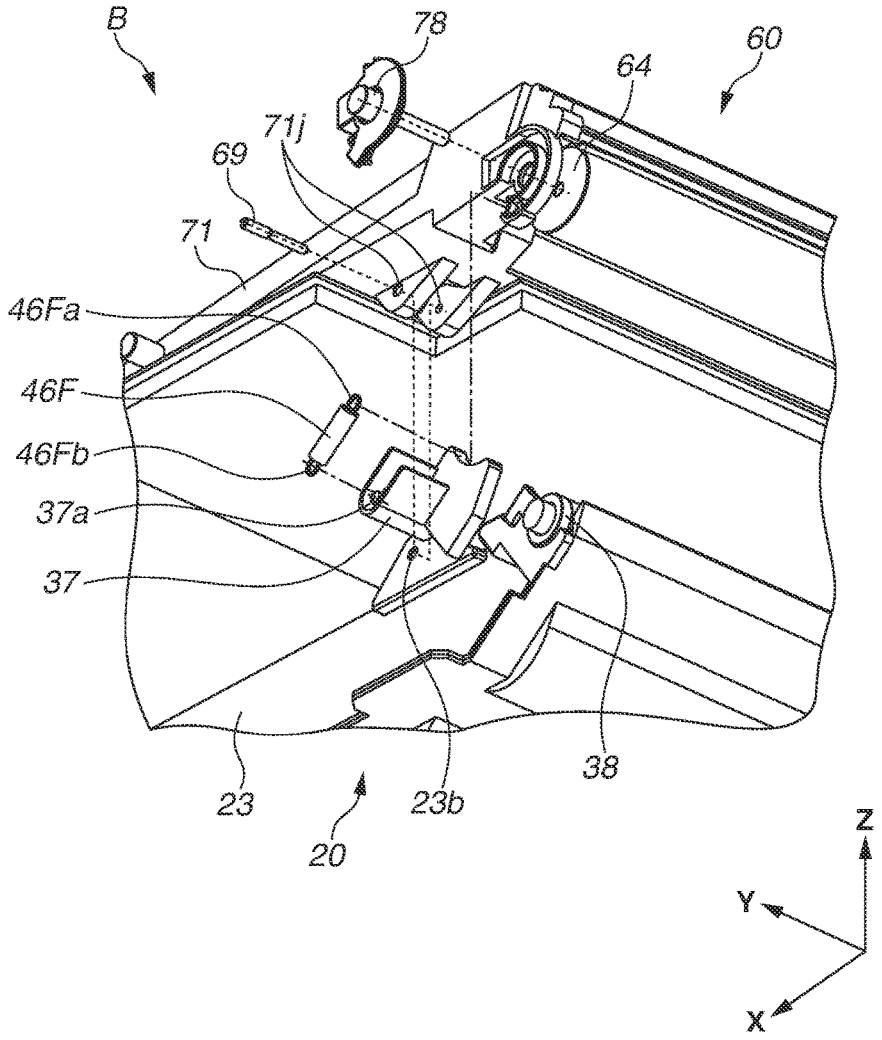
FIG. 11 is an exploded view of the process cartridge.
Figure 12:
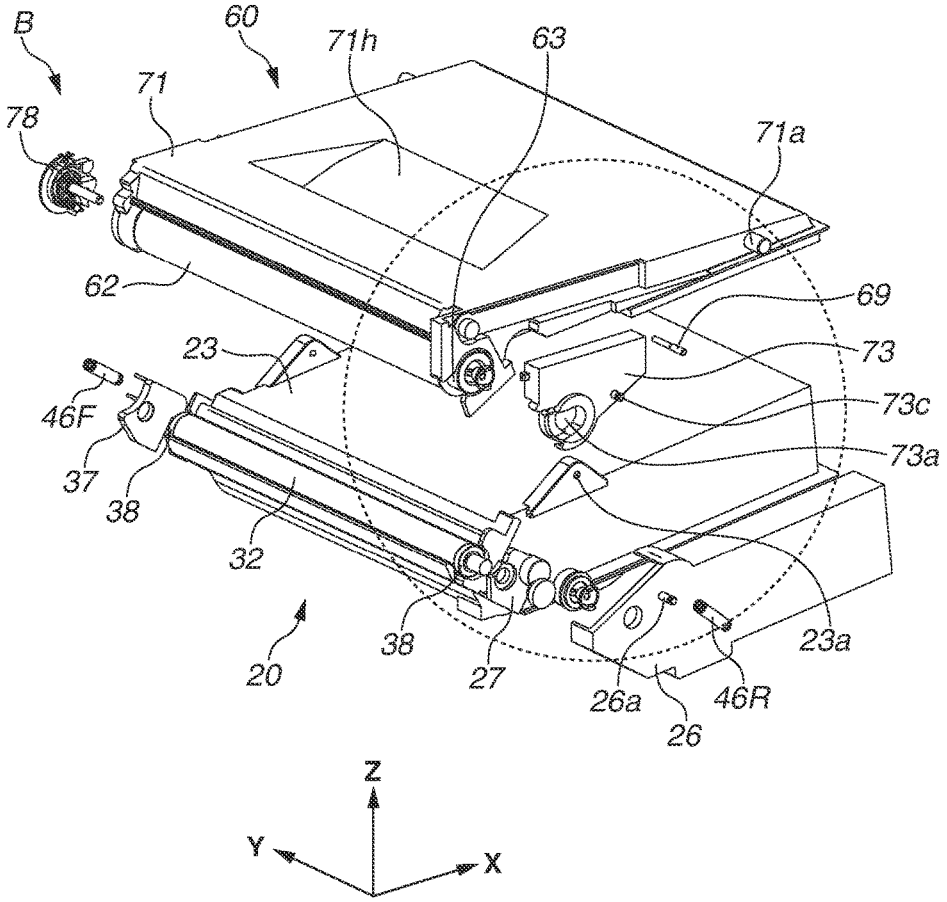
FIG. 12 is an exploded view of the process cartridge.
Figure 13:
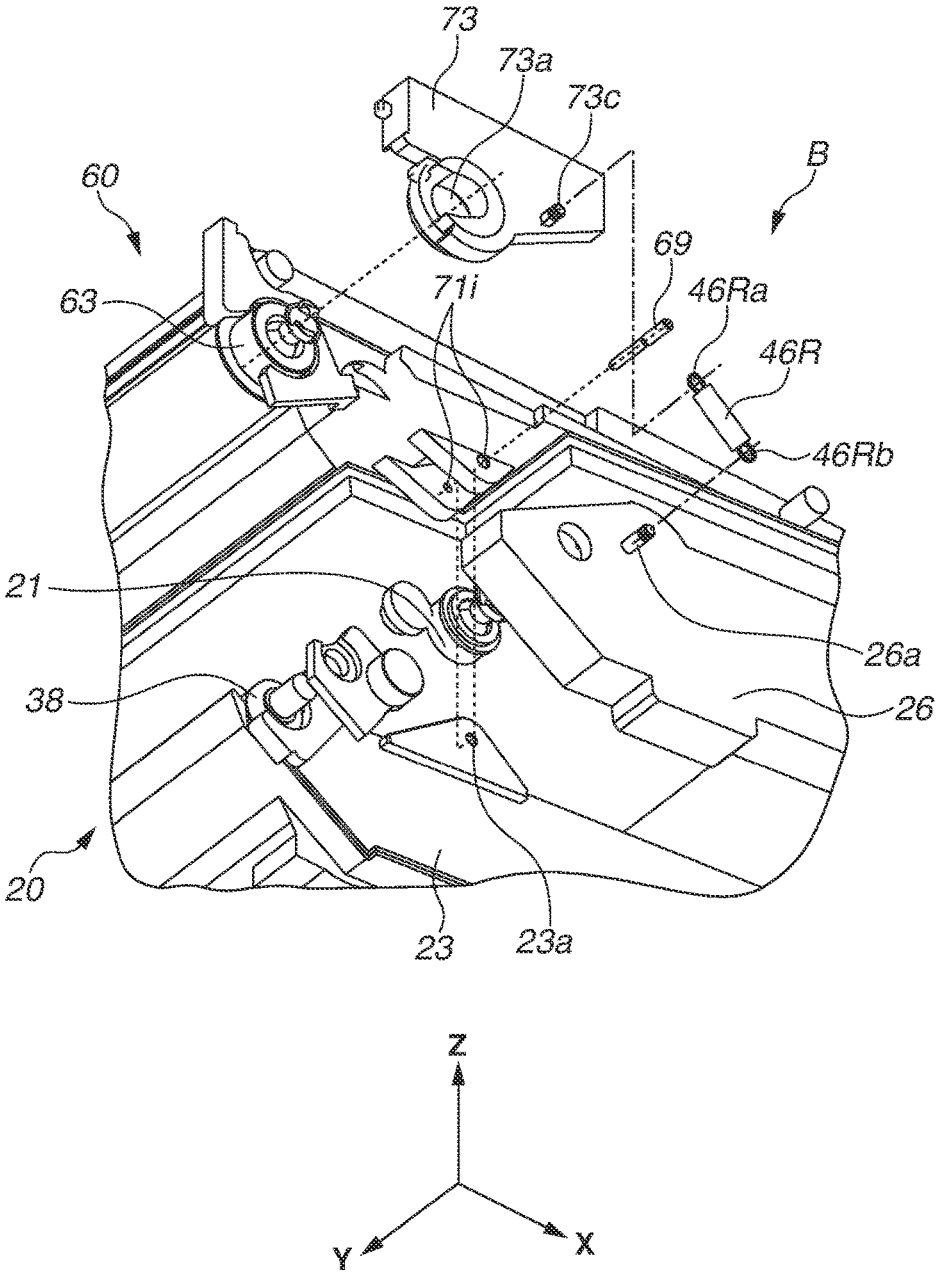
FIG. 13 is an exploded view of the process cartridge.

Next, the overall configuration of the cartridge B will be described with reference to FIGS. 3, 4A, 4B, 10, 11, 12, and 13. FIG. 3 is a sectional view of the cartridge B, and FIGS. 10, 11, 12, and 13 are perspective views for describing the configuration of the cartridge B. FIGS. 11 and 13 are partial enlarged views of the portions enclosed by the dotted lines in FIGS. 10 and 12, respectively, as viewed at a different angle. In the present exemplary embodiment, screws for coupling components are omitted in the description.

The cartridge B includes the cleaning unit 60, which serves as an image carrying member unit, and the developing unit 20. In an exemplary embodiment of the present invention, the process cartridge B includes at least the cleaning unit 60 according to an exemplary embodiment of the present invention.

As illustrated in FIG. 3, the cleaning unit 60 includes the drum 62, the charging roller 66, the cleaning member 77, the cleaning frame 71 that supports the drum 62, the charging roller 66, and the cleaning member 77, and a lid member 72 fixed to the cleaning frame 71 through welding or the like. In the cleaning unit 60, the charging roller 66 and the cleaning member 77 are disposed in contact with the outer peripheral surface of the drum 62.

The cleaning member 77 includes a rubber blade 77*a*, which is an blade-shaped elastic member formed of rubber serving as an elastic material, and a support member 77*b* that supports the rubber blade 77*a*. The rubber blade 77*a* abuts on the drum 62 in the direction counter to the direction of rotation of the drum 62. In other words, the rubber blade 77*a* abuts on the drum 62 such that the leading end of the rubber blade 77*a* is directed upstream in the direction of rotation of the drum 62.

Figure 4A:
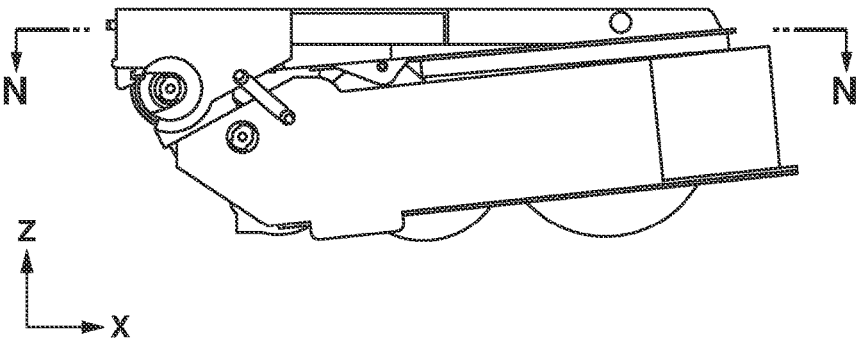
FIGS. 4A and 4B are sectional views of the interior of a cleaning container of the process cartridge.
Figure 4B:
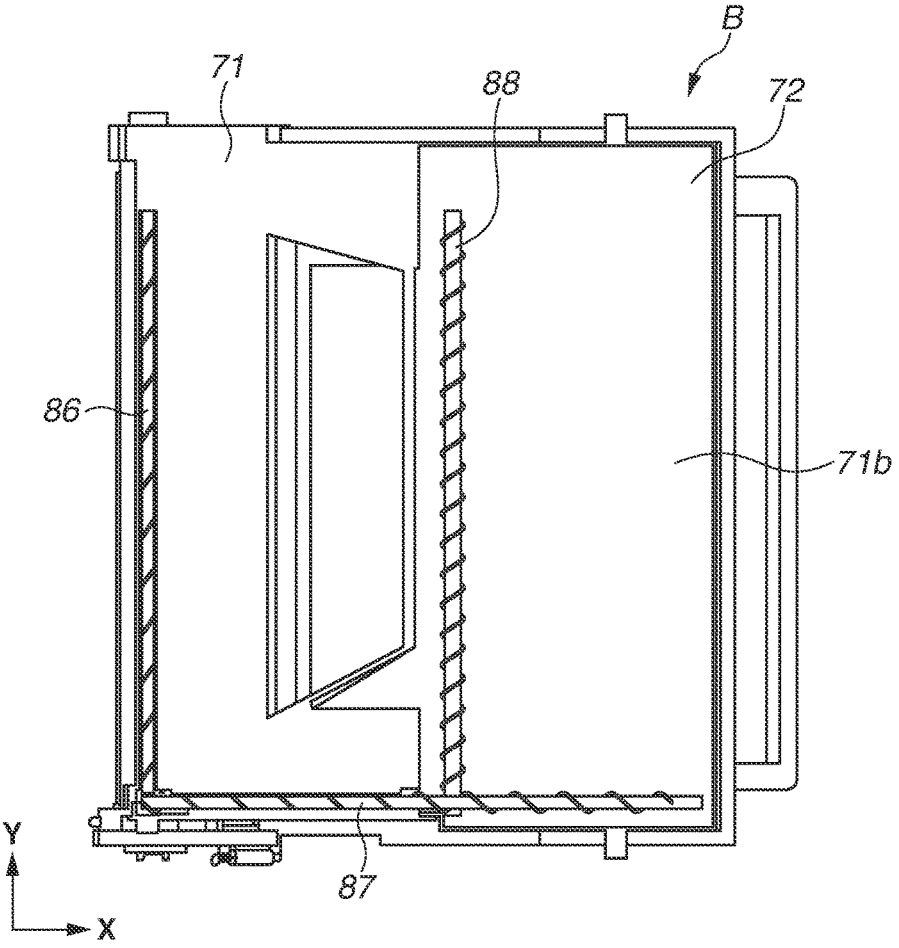

FIG. 4A is a side view of the cleaning frame 71, and FIG. 4B is a sectional view of the cleaning frame 71 cut along the plane N indicated in FIG. 4A and viewed in the −Z-direction. As illustrated in FIGS. 3, 4A, and 4B, the waste toner removed from the surface of the drum 62 by the cleaning member 77 is conveyed by a first screw 86, a second screw 87, and a third screw 88, which serve as waste toner conveyance members. The waste toner is then stored in the waste toner room 71*b* formed by the cleaning frame 71 and the lid member 72. The first screw 86 rotates when the driving force is transmitted from the second coupling 21 illustrated in FIG. 13 via a gear (not illustrated). The second screw 87 rotates when the driving force is received from the first screw 86, and the third screw 88 rotates when the driving force is received from the second screw 87. The first screw 86 is disposed in the vicinity of the drum 62, the second screw 87 is disposed at an edge portion of the cleaning frame 71 in the longitudinal direction, and the third screw 88 is disposed in the waste toner room 71*b*. Here, the axes of rotation of the first screw 86 and of the third screw 88 are parallel to the axis of rotation of the drum 62, and the axis of rotation of the second screw 87 is orthogonal to the axis of rotation of the drum 62.

As illustrated in FIG. 3, a sheet 65 for preventing the waste toner from leaking out of the cleaning frame 71 is provided at an edge portion of the cleaning frame 71 so as to abut on the drum 62.

The drum 62 is rotationally driven in the direction of the arrow R in FIG. 3 in accordance with an image forming operation by the driving force received from a main body driving motor (not illustrated) serving as a driving source.

The charging roller 66 is rotatably attached to the cleaning unit 60 with charging roller bearings 67 interposed therebetween at end portions of the charging roller 66 in the longitudinal direction of the cleaning frame 71 (substantially parallel to the direction of the axis of rotation of the drum 62). The charging roller 66 is in pressure-contact with the drum 62 with the charging roller bearings 67 pressed (urged) toward the drum 62 by urging members 68. The charging roller 66 rotates, driven by the rotation of the drum 62.

As illustrated in FIG. 3, the developing unit 20 includes the developing roller 32, a developing container 23 that supports the developing roller 32, and the developing blade 42. The magnet roller 34 is provided within the developing roller 32. Further, the developing blade 42 for regulating the toner layer on the developing roller 32 is disposed in the developing unit 20. As illustrated in FIGS. 10 and 12, distance retaining members 38 are attached to the developing roller 32 at end portions of the developing roller 32, and the developing roller 32 is held maintaining a tiny clearance from the drum 62 as the distance retaining members 38 abut on the drum 62. As illustrated in FIG. 3, a spew prevention sheet 33 for preventing the toner from leaking out of the developing unit 20 is provided at an edge portion of a base member 22 to abut on the developing roller 32. The first conveyance member 43, the second conveyance member 44, and the third conveyance member 50 are provided in the toner room 29 formed by the developing container 23 and the base member 22. The first conveyance member 43, the second conveyance member 44, and the third conveyance member 50 agitate the toner contained in the toner room 29 and convey the toner to the toner supply room 28.

As illustrated in FIGS. 10 and 12, the cleaning unit 60 and the developing unit 20 together are combined to constitute the cartridge B.

The cleaning unit 60 is provided with the cleaning frame 71, the lid member 72, the drum 62, the drum bearing member 73 for rotationally supporting the drum 62, and the cover member 78. The cleaning frame 71, the lid member 72, the drum bearing member 73, and the cover member 78 are integrated to constitute a unit referred to as a first frame, and the drum 62 is rotatably supported by the first frame. As illustrated in FIG. 13, at the drive side, a drive side drum flange 63 provided on the drum 62 at the drive side is rotatably supported by a hole portion 73*a* in the drum bearing member 73. As illustrated in FIG. 11, at the non-drive side, the cover member 78 fixed to the cleaning frame 71 is configured to rotatably support a hole portion (not illustrated) in a non-drive side drum flange 64.

As illustrated in FIGS. 3, 10, and 12, the developing unit 20 includes the base member 22, the developing container 23, a drive side developing side member 26, the developing blade 42, and the developing roller 32. The developing roller 32 is rotatably attached to the developing container 23 by bearing members 27 and 37 provided at the ends of the developing roller 32. The developing container 23, the bearing member 27, and the bearing member 37 are integrated to constitute a unit referred to as a second frame, and the developing roller 32 is rotatably supported by the second frame.

As illustrated in FIGS. 11 and 13, the cleaning unit 60 and the developing unit 20 are pivotally coupled to each other with coupling pins 69 to constitute the cartridge B.

Specifically, at the end portions of the developing unit 20 in the longitudinal direction, a first developing support hole 23*a* and a second developing support hole 23*b* are provided in the developing container 23. At the end portions of the cleaning unit 60 in the longitudinal direction, first suspension holes 71*i* and second suspension holes 71*j* are provided in the cleaning frame 71. The coupling pins 69 are press-inserted and fixed to the first suspension holes 71*i*, so that the second suspension holes 71*j* are fitted into the first developing support hole 23*a* and the second developing support hole 23*b*, and thus the cleaning unit 60 and the developing unit 20 are pivotally coupled to each other.

A first hole portion 46Ra in a drive side urging member 46R is hooked on a boss 73*c* of the drum bearing member 73, and a second hole portion 46Rb is hooked on a boss 26*a* of the drive side developing side member 26.

At one end portion of a non-drive side urging member 46F, a first hole portion 46Fa is hooked on (engaged with) a boss (engagement portion) 78*e*, which serves as a second projection portion, provided on the cover member 78. At another end portion of the non-drive side urging member 46F, a second hole portion 46Fb is hooked on (engaged with) a boss 37*a* of the bearing member 37.

In the present exemplary embodiment, the drive side urging member 46R and the non-drive side urging member 46F, which serve as urging members, are tensile springs. The developing unit 20 is urged to the cleaning unit 60 by the urging force of the tensile springs, and thus the developing roller 32 is reliably pressed toward the drum 62. The developing roller 32 is held at a predetermined distance from the drum 62 by the distance retaining members 38 attached to the respective end portions of the developing roller 32.

<Cover Member>

Next, the cover member 78 fixed to the non-drive side of the cleaning frame 71 which constitutes the cleaning unit 60 as described above will be described in detail.

Figure 14A:
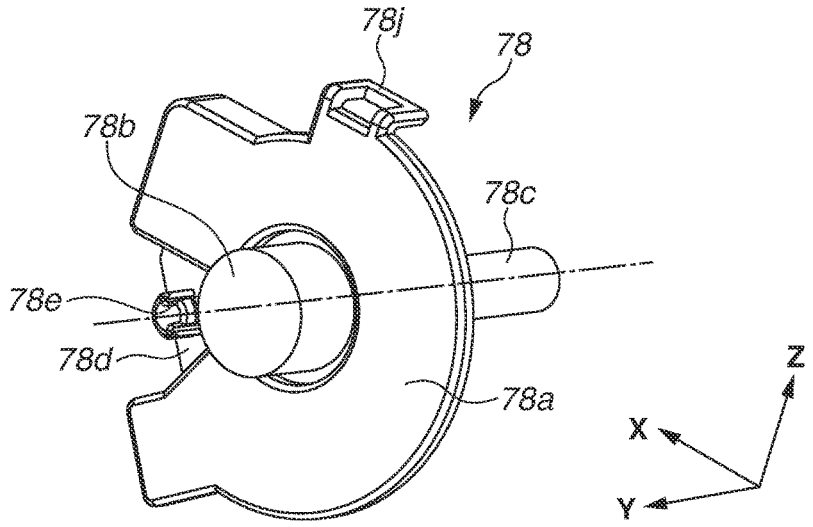
FIGS. 14A and 14B are perspective views of a cover member.
Figure 14B:
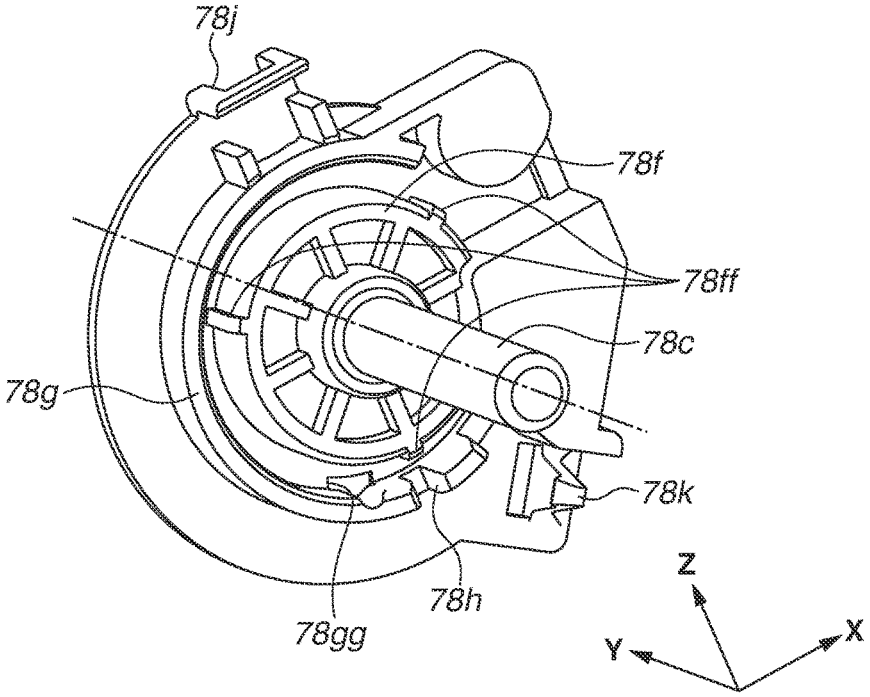
Figure 15E:
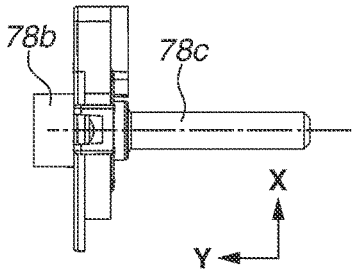
FIGS. 15A-15F illustrates six orthographic views of the cover member.
Figure 15C:
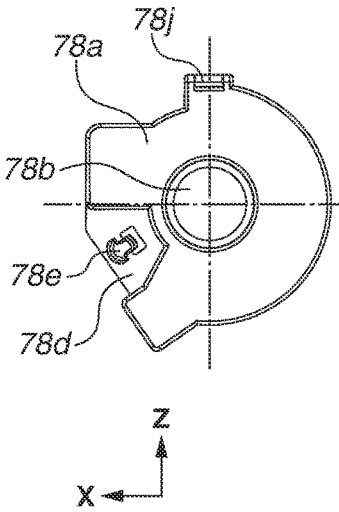
Figure 15A:
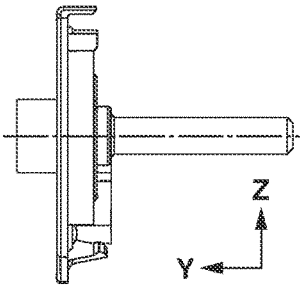
Figure 15D:
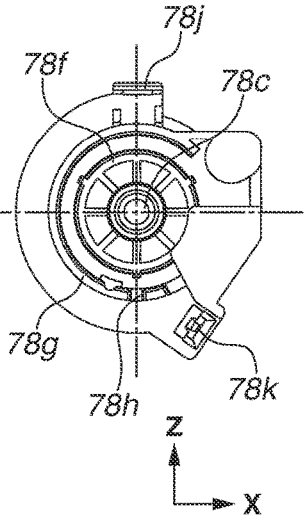
Figure 15F:
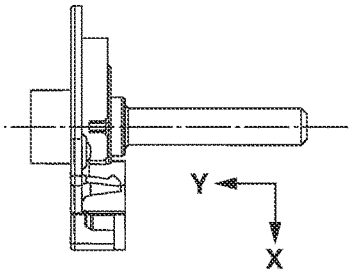
Figure 15B:
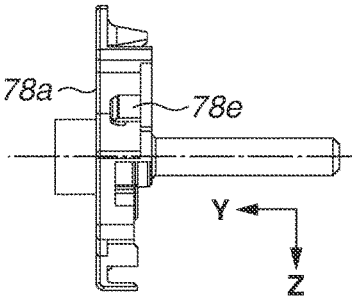

The detailed shape of the cover member 78 will be described with reference to FIGS. 14A, 14B, and FIGS. 15A-15F. FIGS. 14A and 14B are perspective views of the cover member 78, and FIGS. 15A-15F illustrates six orthographic views of the cover member 78, in which FIG. 15A is a front view, FIG. 15B is a rear view, FIG. 15C is a left side view, FIG. 15D is a right side view, FIG. 15E is a top view, and FIG. 15F is a bottom view.

The cover member 78 includes a substantially disc-shaped planar portion 78*a* extending (spans) in X and Z directions indicated by the arrows in FIGS. 14A and 14B. The cover member 78 also includes the non-drive side projection portion (first projection portion) 78*b* projecting from the planar portion 78*a* in the longitudinal direction (Y-direction) and a concave portion 78*d* that is recessed toward the inner side (−Y-direction) from the planar portion 78*a*. The boss (second projection portion) 78*e* is provided on the concave portion 78*d*. In other words, the non-drive side projection portion 78*b* projects from the planar portion 78*a* in the first direction, and the concave portion 78*d* is recessed from the planar portion 78*a* in the second direction. The boss 78*e* and the non-drive side projection portion 78*b* can also be said to project toward the outside (side opposite to the center of the drum 62) from the planar portion 78*a* in the longitudinal direction. It can also be said that the concave portion 78*d* is recessed from the planar portion 78*a* toward the center of the drum 62 in the longitudinal direction. In a similar manner, it can be said that the boss 78*e* projects from the bottom surface of the concave portion 78*d* (surface closest to the center of the drum 62) toward the outside (side opposite to the center of the drum 62) in the longitudinal direction. In other words, the boss 78*e* projects from the concave portion 78*d* in the first direction. The non-drive side projection portion 78*b* is a cylinder having a center axis that coincides with the axis of rotation of the drum 62. As can be seen from the front view illustrated in the section FIG. 15B, the leading end portion of the boss 78*e* is located on the inner side (toward the center of the drum 62) of the planar portion 78*a* in the longitudinal direction.

The cover member 78 includes a shaft portion 78*c* extending in the direction opposite to the non-drive side projection portion 78*b* with respect to the planar portion 78*a* and that is thinner than the non-drive side projection portion 78*b*. The shaft portion 78*c* is a support shaft that rotatably supports the drum 62. In other words, the shaft portion 78*c* projects from the planar portion 78*a* in the second direction, and the diameter of the shaft portion 78*c* is smaller than the diameter of the non-drive side projection portion 78*b* (refer to FIGS. 15A-15F and FIG. 18 as well). A cylinder portion 78*f* and an arc portion 78*g* are provided on the outer side of the shaft portion 78*c* in the outer peripheral radial direction of the shaft portion 78*c*. Ribs 78*ff* are provided at three locations on the cylinder portion 78*f* in the circumferential direction. In addition, a positioned surface 78*gg* that fits with a positioning surface provided on the cleaning frame 71, which is described below, and a groove portion 78*h* formed by cutting out a peripheral portion of the arc portion 78*g* are provided in the arc portion 78*g*. Claw portions 78*j* and 78*k* to be locked to locking portions on the cleaning frame 71 are provided. In the cover member 78, the non-drive side projection portion 78*b* and the shaft portion 78*c* are metal shafts, while other components are made of resin.

Figure 16:
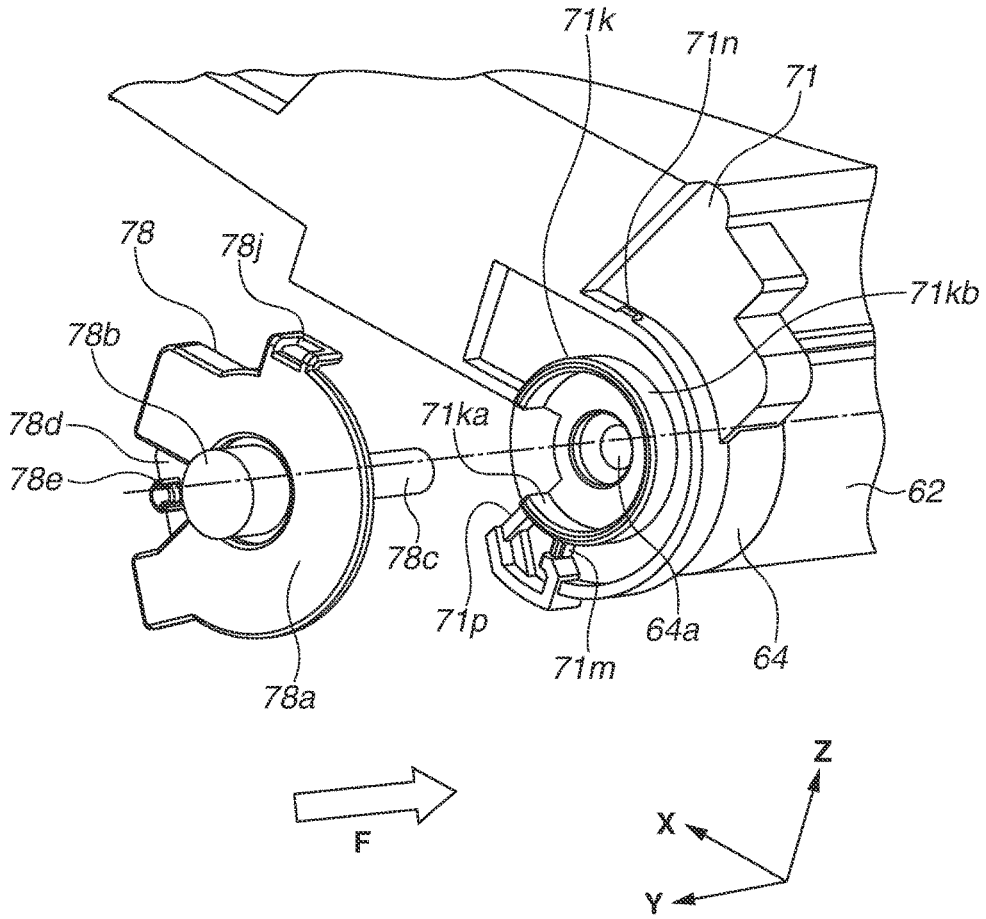
FIG. 16 is an exploded perspective view of the process cartridge.
Figure 17:
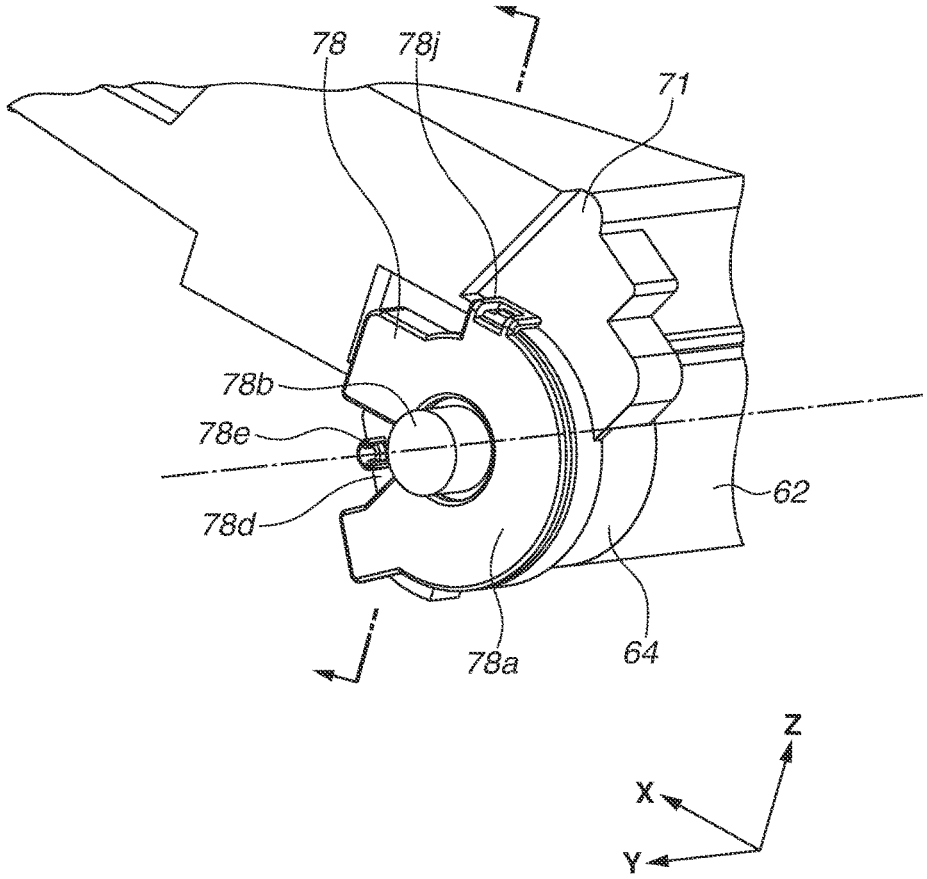
FIG. 17 is a perspective view of the process cartridge.
Figure 18:
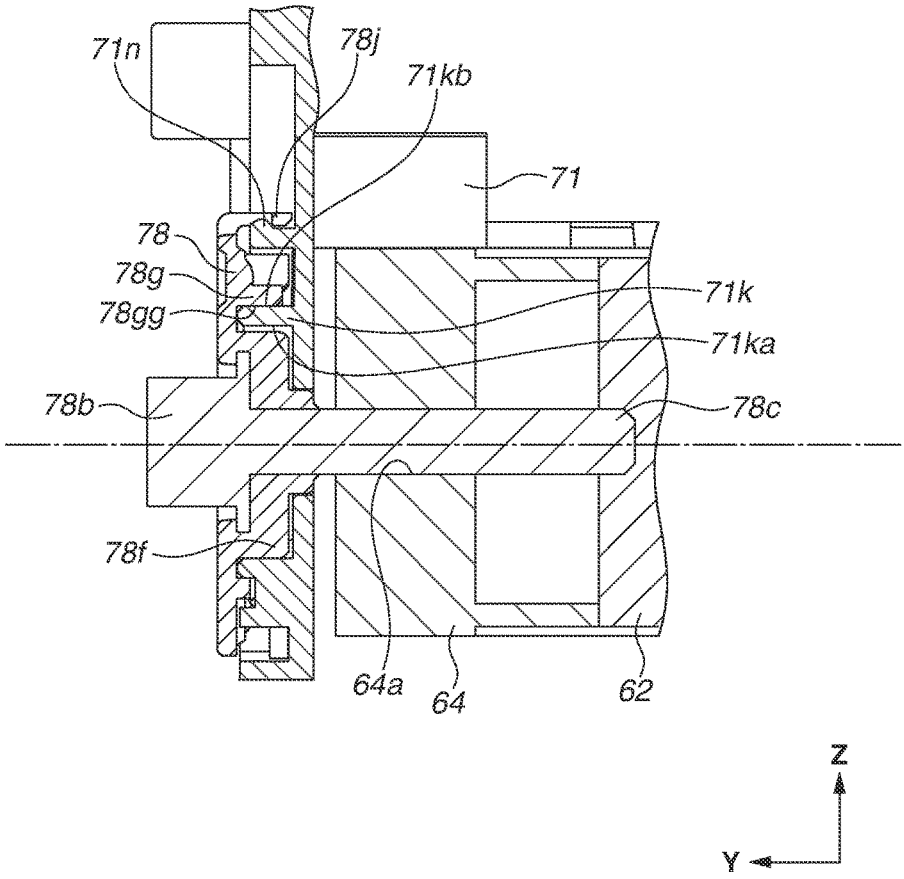
FIG. 18 is a sectional view of the process cartridge.

Next, positioning and a method of fixing the cover member 78 to the cleaning frame 71, and a method of supporting the drum 62 will be described with reference to FIGS. 16 through 18. FIG. 16 is a perspective view illustrating a state before the cover member 78 is fixed to the cleaning frame 71, and FIG. 17 is a perspective view illustrating a state after the cover member 78 has been fixed to the cleaning frame 71. FIG. 18 is a sectional view of FIG. 17.

The cover member 78 is mounted in the direction of the arrow F in FIG. 16 (−Y-direction), and thus the cover member 78 is fixed to the cleaning frame 71, resulting in the state illustrated in FIG. 17. As illustrated in FIG. 16, the cleaning frame 71 is provided with an arc portion 71*k*, a rib 71*m*, and locked portions 71*n* and 71*p*, and the arc portion 71*k* includes an inner peripheral surface 71*ka* and a positioning surface 71*kb*, which is an outer peripheral surface. Similarly to the drive side, the non-drive side drum flange 64 is fixed to the drum 62, and the non-drive side drum flange 64 is provided with a hole portion 64*a*.

First, positioning of the cover member 78 to the cleaning frame 71 will be described. When the cover member 78 is mounted in the direction of the arrow F in FIG. 16, the non-positioning surface 78*gg* and the positioning surface 71*kb* are fitted together as illustrated in FIG. 18. At this time, the groove portion 78*h* and the rib 71*m* are also fitted together, and thus the cover member 78 is positioned with respect to the cleaning frame 71.

Next, a method of fixing the cover member 78 to the cleaning frame 71 will be described. As described above, the cover member 78 is provided with the claw portions 78*j* and 78*k*, and the claw portions 78*j* and 78*k* are locked to the locking portion 71*n* and 71*p* when the cover member 78 is mounted on the cleaning frame 71. Further, the ribs 78*ff* provided at three locations on the cylinder portion 78*f* in the circumferential direction are formed to have outer peripheral surfaces larger than the inner peripheral surface 71*ka* of the arc portion 71*k* provided in the cleaning frame 71. Therefore, when the cover member 78 is mounted on the cleaning frame 71, the ribs 78*ff* are press-inserted and fixed to the inner peripheral surface 71*ka*. An adhesive (not illustrated) is applied between the non-positioning surface 78*gg* and the positioning surface 71*kb* that are fitted together, so that the non-positioning surface 78*gg* and the positioning surface 71*kb* are bonded together.

The shaft portion 78*c* is inserted into the hole portion 64*a* provided in the non-drive side drum flange 64 and is fitted therein. Thus, the drum 62 is rotatably supported by the shaft portion 78*c*.

As described above, the cover member 78 is positioned with respect to the cleaning frame 71 and is fixed thereto. At this point, the cover member 78 rotatably supports the drum 62 with the shaft portion 78*c*.

Next, positioning of the cartridge B relative to the apparatus main body A will be described with reference to FIGS. 1 and 19. The cartridge B is constituted by combining the developing unit 20 and the cleaning unit 60 formed by mounting the cover member 78 on the cleaning frame 71. FIG. 1 is a perspective view illustrating a state in which the cartridge B is positioned to the apparatus main body A, and FIG. 19 is a side view thereof.

With reference to FIG. 1, the non-drive side projection portion 78*b* provided in the cover member 78 is supported by the non-drive side first support 16*a* and the non-drive side second support 16*b*. Thus, the cartridge B is positioned relative to the apparatus main body A.

Here, the boss 78*e*, which supports the non-drive side urging member 46F, is provided on the concave portion 78*d* that is recessed toward the inner side from the planar portion 78*a* of the cover member 78. The boss 78*e* is provided such that the leading end thereof does not project to the outside from the planar portion 78*a*, and only the non-drive side projection portion 78*b* projects to the outside from the planar portion 78*a*. In other words, with regard to the first direction, the leading end of the boss 78*e* is located upstream from the planar portion 78*a*. Thus, the non-drive side first support 16*a* and the non-drive side second support 16*b* can be disposed in the vicinity of the planar portion 78*a* in the longitudinal direction. Therefore, the dimension of the cartridge B and the apparatus main body A can be reduced in the longitudinal direction.

Figure 19:
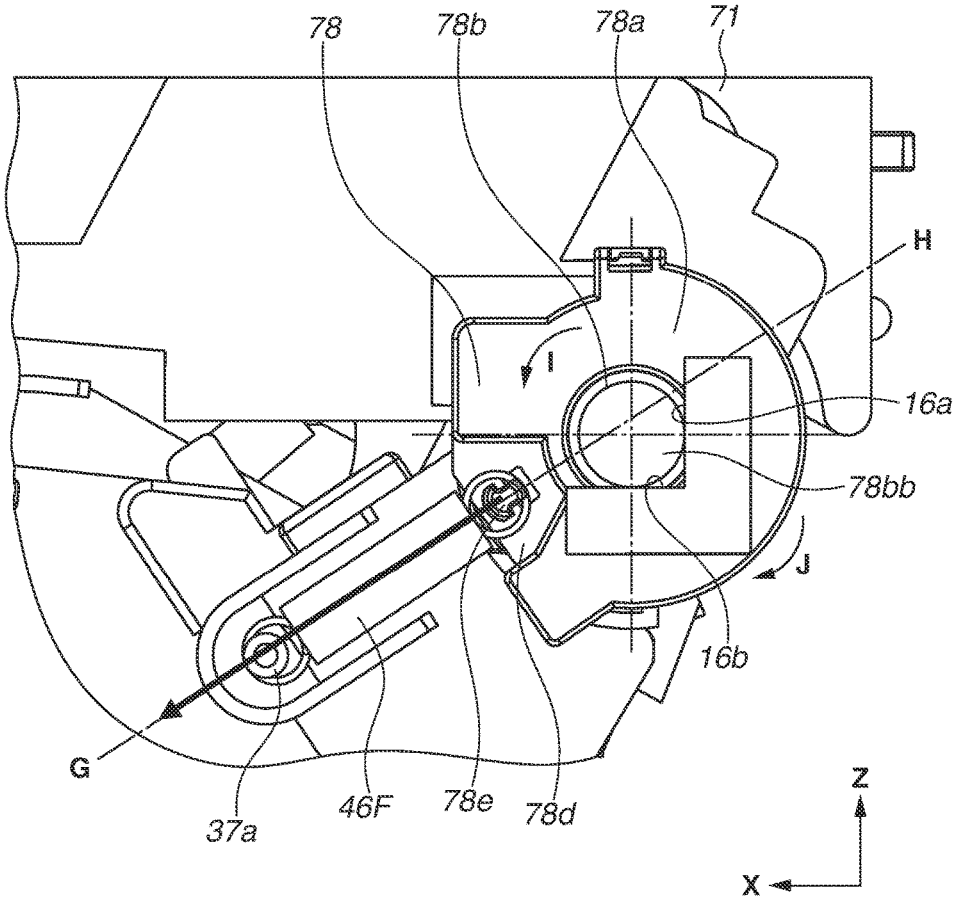
FIG. 19 is a side view of the non-drive side of the process cartridge.

With reference to FIG. 19, the straight line H connecting the boss 78*e* and the urging direction (the arrow G in FIG. 19) of the non-drive side urging member 46F passes through an end surface 78*bb* of the non-drive side projection portion 78*b*. In other words, the non-drive side projection portion 78*b* is disposed on the straight line H connecting the boss 37*a* and the boss 78*e*. Thus, the cover member 78 does not deform in the directions of the arrows I and J in FIG. 19 under the urging force of the non-drive side urging member 46F. Therefore, the cartridge B is stably positioned relative to the apparatus main body A by the cover member 78.

As described thus far, with the use of the cover member 78 of the present configuration, the dimension of the cartridge B and the apparatus main body A can be reduced in the longitudinal direction. In addition, the cartridge B relative to the apparatus main body A can be stably positioned.

According to the present exemplary embodiment, a cartridge provided with a photosensitive drum is more advanced than a conventional cartridge.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-203144, filed Oct. 14, 2015, which is hereby incorporated by reference herein in its entirety.

What is claimed is:

1. A cartridge detachably mountable on an apparatus main body of an image forming apparatus, the cartridge comprising:

a first unit that includes a photosensitive drum and a first frame supporting the photosensitive drum so that the photosensitive drum is rotatable;

a second unit that includes a developing roller configured to supply developer to the photosensitive drum and a second frame supporting the developing roller so that the developing roller is rotatable;

an attachment attached to one end of the first unit in a direction of an axis of rotation of the photosensitive drum, the attachment including:

a first surface extending in a direction orthogonal to the axis of rotation, a first projection portion projecting, toward an outside in the direction of the axis of rotation, further than the first surface, a second surface extending in the direction orthogonal to the axis of rotation and recessed from the first surface toward an inner side in the direction of the axis of rotation, and a second projection portion provided in the second surface, the second projection portion projecting further than the second surface toward the outside in the direction of the axis of rotation; and an urging member configured to urge the developing roller against the photosensitive drum, one end and the other end of the urging member being configured to engage with the second projection portion of the attachment and a part of the second unit, respectively.

2. The cartridge according to claim 1, wherein the second projection portion has a length in which a tip of the second projection portion does not protrude further than the first surface.

3. The cartridge according to claim 1, wherein the first projection portion is disposed on a straight virtual line passing through both the second projection portion and the part of the second unit when viewed in the direction of the axis of rotation.

4. The cartridge according to claim 1, wherein the cartridge is configured to be mountable on the apparatus main body in a direction crossing with the axis of rotation, and wherein the first projection portion contacts with a positioning portion of the apparatus main body so that the first unit is positioned, in the direction crossing the axis of rotation, with respect to the apparatus main body.

5. The cartridge according to claim 1, wherein the first projection portion is a shaft having a center axis coaxially arranged with the axis of rotation.

6. The cartridge according to claim 5, wherein when the shaft is a first shaft, the attachment includes a second shaft configured to support the photosensitive drum, the second shaft extending in a direction opposite to a direction in which the first shaft extends and being coaxially arranged with the first shaft.

7. The cartridge according to claim 6, wherein the second shaft is smaller than the first shaft in diameter.

8. The cartridge according to claim 7, wherein the second shaft is longer than the first shaft in length.

9. The cartridge according to claim 1, wherein the first unit and the second unit are pivotally coupled to each other.

* * * * *